US005673451A

United States Patent [19]

Moore et al.

[11] Patent Number: 5,673,451

[45] Date of Patent: Oct. 7, 1997

[54] INSTRUCTIONAL TOOTHBRUSH

[76] Inventors: James R. Moore; Julia C. Moore, both of 5652 W. Melinda La., Glendale, Ariz. 85308

[21] Appl. No.: 498,582

[22] Filed: Jul. 6, 1995

[51] Int. Cl.[6] ..... A46B 9/04

[52] U.S. Cl. ..... 15/105; 15/167.1; 434/263

[58] Field of Search ..... 15/105, 167.1, 15/167.2, 159.1; 434/263

[56] References Cited

U.S. PATENT DOCUMENTS

| | | | |
|---|---|---|---|
| 2,877,477 | 3/1959 | Levin | 15/105 |
| 2,947,013 | 8/1960 | Silverman | 15/105 |
| 4,253,212 | 3/1981 | Fujita | 434/263 |
| 4,716,614 | 1/1988 | Jones | 15/105 |
| 4,744,124 | 5/1988 | Wang | 15/105 |
| 4,788,734 | 12/1988 | Bauer | 15/105 |
| 4,866,807 | 9/1989 | Krett | 15/105 |
| 5,133,102 | 7/1992 | Sakuma | 15/167.1 |
| 5,134,743 | 8/1992 | Hukuba | 15/105 |
| 5,339,479 | 8/1994 | Lyman | 15/105 |
| 5,438,726 | 8/1995 | Leite | 15/105 |
| 5,485,646 | 1/1996 | Merritt | 15/105 |

*Primary Examiner*—David Scherbel
*Assistant Examiner*—Randall E. Chin
*Attorney, Agent, or Firm*—Parsons & Goltry; Robert A. Parsons; Michael W. Goltry

[57] ABSTRACT

A toothbrush adapted to serve as an instructional aid to encourage toothbrushing and to reinforce recommended toothbrushing technique. The toothbrush includes a body having an electrical subassembly incorporating a visual indicator such as a light or a light emitting diode, and a switching unit within the electrical subassembly for selectively activating the visual indicator only when the toothbrush is being used according to recommended toothbrushing technique. An alternate embodiment of the toothbrush includes a separate toothbrush head insert and a separate handle for receiving the toothbrush head insert which can therefore be removed and replaced. A further alternate embodiment of the invention includes an aural indicator selectively activated by the electrical subassembly during recommended toothbrushing technique.

25 Claims, 2 Drawing Sheets

FIG. 1
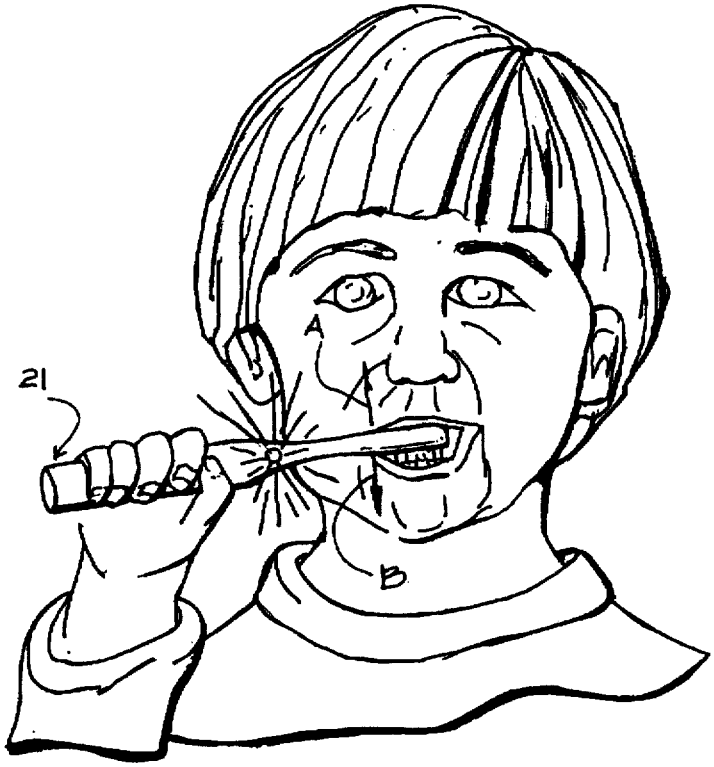
FIG. 2
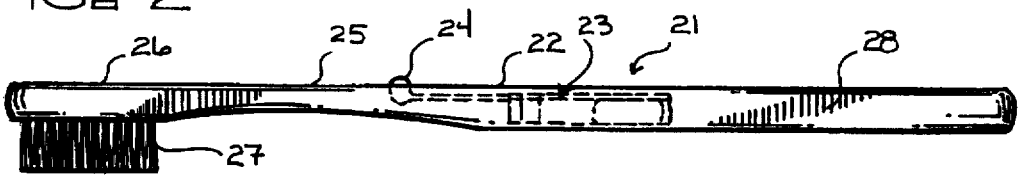
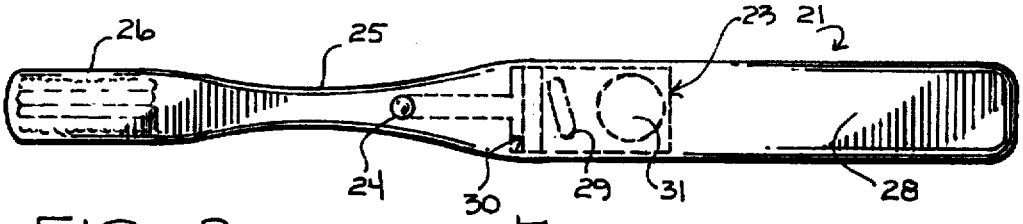
FIG. 3
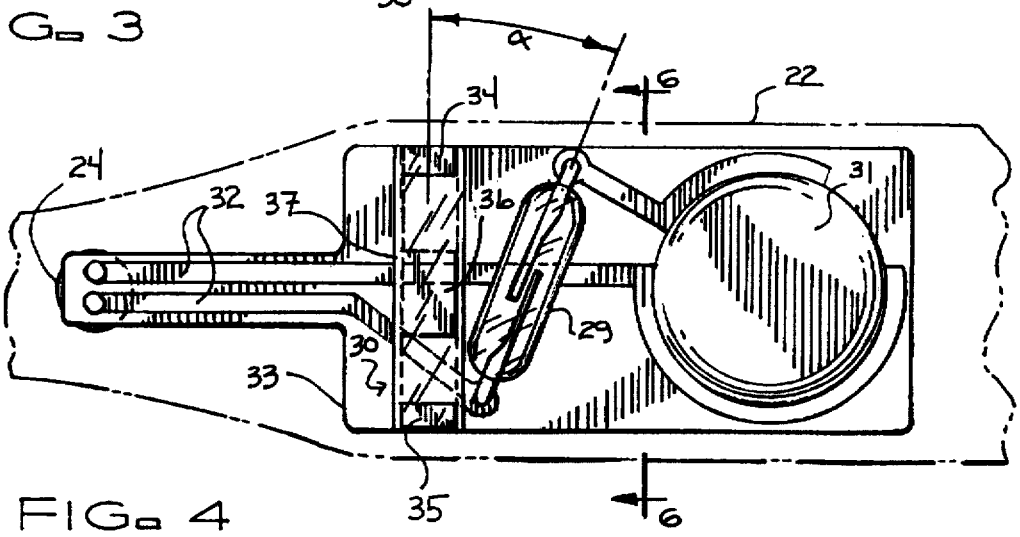
FIG. 4

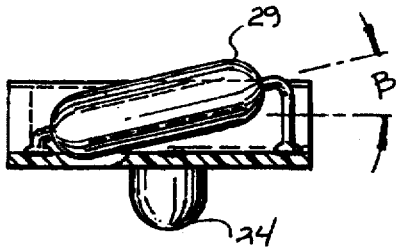
FIG. 6
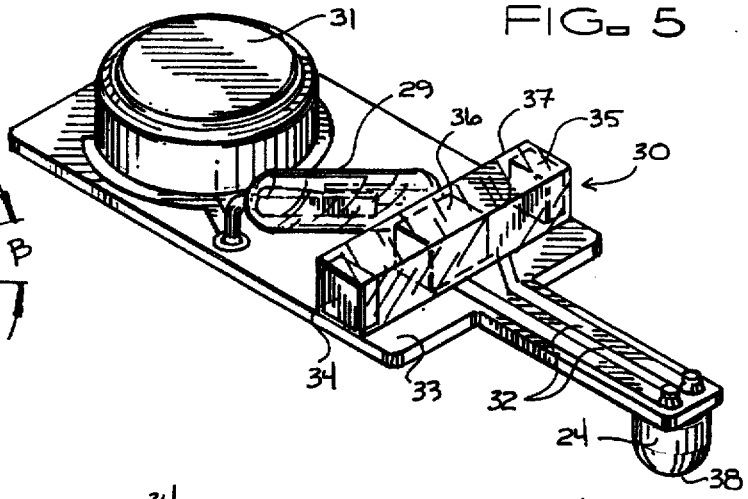
FIG. 5
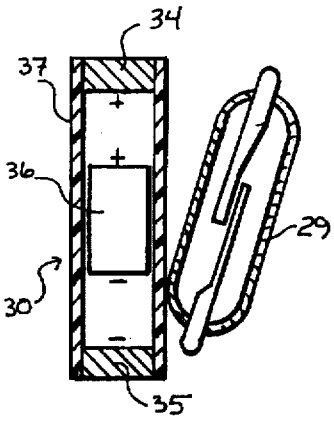
FIG. 7
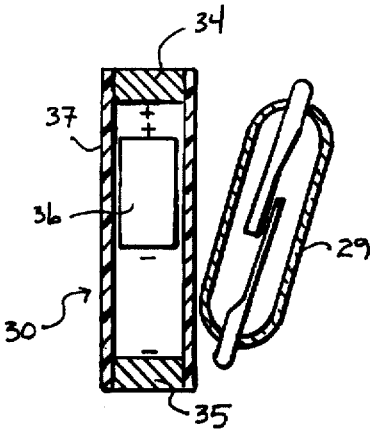
FIG. 8
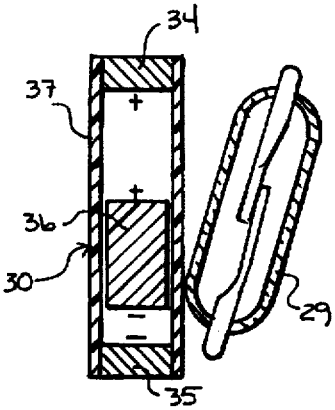
FIG. 9
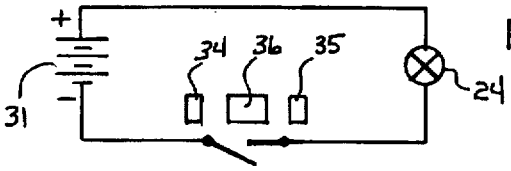
FIG. 10
FIG. 11
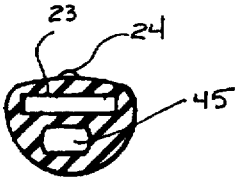
FIG. 13
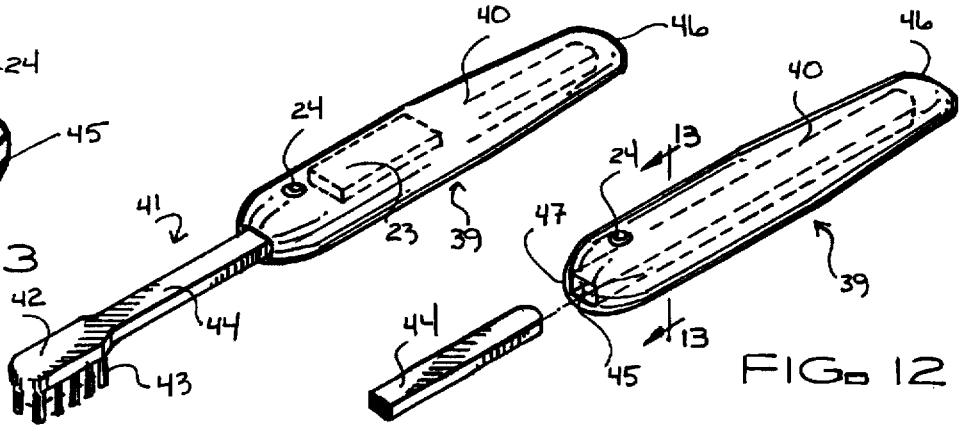
FIG. 12

INSTRUCTIONAL TOOTHBRUSH

BACKGROUND OF THE INVENTION

1. Field of the Invention

This invention relates to the art of dental hygiene.

More particularly, the present invention relates to a toothbrush for encouraging toothbrushing.

In a further and more specific aspect, the present invention concerns a toothbrush for reinforcing recommended toothbrushing technique.

2. Prior Art

Toothbrushes are well known and commonly employed to maintain dental hygiene. Toothbrushes are routinely used daily or more often to brush teeth in order to remove food particles, plaque and other debris from around the teeth and gums. Although there are many varieties of toothbrushes to choose from, the commercially available toothbrushes do not aid the user or dental hygiene professional to exercise or reinforce recommended toothbrushing technique. Most dental hygiene professionals recommend brushing the teeth by moving the toothbrush in a reciprocal lateral direction with the toothbrush held in a general horizontal position during brushing to facilitate safe and efficient cleaning of the teeth and gums.

Most people typically brush their teeth with a toothbrush at least once each day. However, some people may not brush their teeth as often as once each day. Also, the application of recommended toothbrushing technique with the use of a toothbrush is essential to ensure that teeth are safely and efficiently cleaned, to ensure that teeth are not damaged, and to ensure that the gums surrounding the base of the teeth are not damaged as a result of brushing. However, many people fail to routinely exercise recommended toothbrushing technique. Further, they fail to brush often enough and/or for a sufficient duration of time to adequately clean their teeth. As a consequence, there is a failure to minimize cavities and other problems associated with poor brushing habits.

In response to toothbrushers' needs, the prior art has devised various toothbrushes for enhancing the ability of the user to clean teeth and to reach hard-to-clean areas such as the backs of the teeth and the teeth located in the rear of the mouth. Exemplary are toothbrushes having an angled head to aid the user in more efficiently reaching and cleaning teeth located in the rear of the mouth and also to aid the user in more easily cleaning the back of the teeth. Also known are toothbrushes having toothbrush bristles of various configurations and contours to aid the user in cleaning the base of the teeth closest to the gums and also to more thoroughly clean the areas between the teeth.

The foregoing have not, however, adequately attended to the toothbrushers' need for exercising recommended toothbrushing technique, and to render immediate instructional aid to the user and dental hygiene professional for reinforcing and encouraging recommended toothbrushing technique for safely and efficiently cleaning teeth. Also, the prior art toothbrush technology has not adequately attended to encouraging more frequent and longer toothbrushing sessions.

It would be highly advantageous, therefore, to remedy the foregoing and other deficiencies inherent in the relevant prior art.

Accordingly, it is a broad object of the present invention to provide a new and improved toothbrush.

Another object of the present invention is to reinforce recommended toothbrushing technique.

And another object of the invention is to encourage longer toothbrushing sessions.

Still another object of the invention is to make toothbrushing sessions more enjoyable.

Yet another object of the invention is to encourage more toothbrushing sessions.

Yet still another object of the invention is to provide a training aid that provides immediate feedback to the user and the dental hygiene professional of the attainment of recommended toothbrushing technique In another aspect, it is an object of the invention to provide visually impaired persons with a means to reinforce recommended toothbrushing technique.

Still another object of the invention is to limit damage to the gums by encouraging recommended toothbrushing technique.

Yet another object of the invention is to minimize problems associated with poor toothbrushing technique.

Another object of the invention is to reinforce recommended toothbrushing technique with children.

SUMMARY OF THE INVENTION

Briefly, to achieve the foregoing and other desired objects of the present invention in accordance with a preferred embodiment thereof, there is provided a main body portion of the toothbrush with an indicator. Next provided is an electrical circuit, including a battery, within the body for actuating the indicator only when the user employs recommended toothbrushing technique during brushing. The indicator is selectively energized by a switching mechanism responsive only to recommended toothbrushing technique to encourage use of the same. In an alternative configuration, the body portion of the toothbrush includes a separate handle, with the electrical circuit and the indicator, that serves as a universal receptacle for toothbrush head inserts.

BRIEF DESCRIPTION OF THE DRAWING

The foregoing and further and more specific objects and advantages of the instant invention will become readily apparent to those skilled in the art from the following detailed description of a preferred embodiment thereof taken in conjunction with the drawing, in which:

FIG. 1 is a perspective view of an individual using a toothbrush, constructed in accordance with the teachings of the instant invention, as the toothbrush appears in use;

FIG. 2 is a side elevational view of the toothbrush of FIG. 1;

FIG. 3 is a top plan view of the toothbrush of FIG. 1;

FIG. 4 is an enlarged top plan view of the electrical subassembly of the present invention, the toothbrush being shown in fragmentary broken outline;

FIG. 5 is a perspective view of the electrical subassembly seen in FIG. 4;

FIG. 6 is a vertical sectional view of the electrical subassembly taken along the line 6—6 of FIG. 4;

FIG. 7 is a semi-schematic fragmentary top view of the switch mechanism of the electrical subassembly, shown in an open position with an actuator in a first, normal position, located within the electrical subassembly;

FIG. 8 is a view similar to the view of FIG. 7 showing the mechanism in an open position with the actuator in a second position;

FIG. 9 is a view similar to the view of FIG. 7 showing the mechanism in a closed position with the actuator in a third position;

FIG. 10 is a schematic representation of the electrical subassembly;

FIG. 11 is perspective view of an alternate embodiment of the present invention having a handle and a separable toothbrush head insert;

FIG. 12 is a perspective view of the embodiment shown in FIG. 11 and illustrating the toothbrush head insert separated from the handle; and FIG. 13 is a vertical sectional view taken along the line 13—13 of FIG. 12.

DETAILED DESCRIPTION OF THE PREFERRED EMBODIMENT

Turning now to the several figures of the drawing in which like reference characters indicate corresponding elements throughout the several views, attention is first directed to FIGS. 1, 2 and 3, which illustrate a toothbrush generally designated by the reference character 21. In FIG. 1, the toothbrush 21 is shown in typical use by a young man.

Toothbrush 21 includes an elongate body portion 22 having a head 26 and a handle 28, and a neck 25 therebetween. The head 26 of toothbrush 21 includes toothbrush bristles 27 attached or embedded into the head 26 in the manner well known in the art. An indicator, such as light 24 (which may, for example, be a light emitting diode or "LED," or an aural indicator such as a bell or a buzzer, all of which are readily apparent to those skilled in the art.), having an optically clear surface 38 is located on the elongate body portion 22 of the toothbrush 21.

Referring also to FIGS. 4 and 5, the light 24 is electrically connected by conductors 32 on a printed circuit board 33 to an electrical subassembly 23 of the toothbrush 21. The electrical subassembly includes a power source 31 and a magnetically-actuated reed switch 29 connected in series with the light 24. As will be appreciated by those skilled in the art, the power source 31 may be a small battery of the button type widely used in watches, calculators and the like. The rated voltage of the battery must be at least sufficient to turn on the light 24 which may be employed as the brushing indicator.

The reed switch 29 is angularly positioned, as seen with reference to the angle designated $\alpha$ in FIG. 4 and the angle designated $\beta$ in FIG. 6, adjacent a magnet subassembly 30 which serves to selectively activate the reed switch 29 as will be described in detail below. As illustrated in FIGS. 7, 8 and 9, the magnet subassembly 30 includes a first stationary magnet 34 and a second stationary magnet 35 positioned at opposite ends of magnet assembly housing 37. A movable magnet 36 is positioned between the first stationary magnet 34 and the second stationary magnet 35. The movable magnet 36 is moveable bidirectionally within the housing 37 between the first stationary magnet 34 and the second stationary magnet 35 which are both oriented to repel the movable magnet 36. Thus, it will be understood that the normal position of the movable magnet 36 is more or less central between the stationary magnets 34, 35 as shown in FIG. 7. However, movement of the toothbrush in the recommended reciprocal lateral direction while held by the user in a general horizontal position will permit the inertia of the movable magnet to cause it to move closer to one or the other of the stationary magnets against their mutual repulsion.

More particularly, when the toothbrush 21 is vigorously moved in the recommended reciprocal lateral direction while held by the user in a general horizontal position, the movable magnet 36 moves bidirectionally between the first stationary magnet 34 and the second stationary magnet 35. That is, movement of the toothbrush 21 is the recommended fashion causes the moveable magnet 36 to translate up and down within the housing 37 against the repulsion of the stationary magnets 34, 35 and in an instantaneous direction opposite to that of the toothbrush. It will be appreciated that this effect is readily achieved by orienting the magnet assembly housing 37 generally aligned with respect to the direction of the recommended toothbrushing technique. It will further be appreciated that, with this arrangement, the desired effect is obtained whether the user is left handed or right handed.

When the movable magnet 36 moves closest to the reed switch 29 in the direction of the second stationary magnet 35, the reed switch, attracted by the magnetic field of the movable magnet, closes, thereby completing the electrical circuit (see FIG. 10) consisting of the power source 31, the reed switch 29 and the light 24. As a result, the light 24 is momentarily activated. When the movable magnet 36 moves away from the second stationary magnet 35, the reed switch 29 opens which interrupts the electrical circuit, which in turn deactivates the light 24.

This action may be more readily understood with reference to FIGS. 7, 8 and 9. FIG. 7 shows the movable magnet 36 centrally disposed between the stationary magnets as would be the case when there is no or little movement of the toothbrush in a direction coaxial to the magnet assembly housing 37. When the toothbrush 21 is moved in a direction generally along the length of the magnet assembly housing 37, as when recommended toothbrushing activity is taking place, the movable magnet 36 will translate toward one or the other of the stationary magnets 34, 35 according to the instantaneous direction of movement.

When the movement of the toothbrush is such as to cause the movable magnet 36 to translate toward the stationary magnet 34 as shown in FIG. 8, the reed switch remains open. However, when movement of the toothbrush is in the opposite direction to cause the movable magnet to move proximate the stationary magnet 35 as shown in FIG. 9, its magnet field in the region of the movable contact of the reed switch 29 is sufficiently strong as to cause the reed switch to close, thus transiently energizing the light 24. It will be seen that, if the recommended toothbrushing technique is employed, the light will flash at the same rate as the toothbrush is moved. This result is pleasing to the user, particularly a child who may be watching his reflection in a mirror, such that not only is recommended toothbrushing technique positively reinforced, but also the length of time that brushing continues tends to increase.

Referring briefly to FIG. 6, the "snap action" sensitivity of the reed switch 29 may be increased, if desired, by slightly angling it with respect to the plane of the toothbrush body 22 such that, when the movable magnet is in the positions shown in FIGS. 7 and 8, the reed switch 29 will be slightly further from the movable magnet 36 while, when the movable magnet is in the position shown in FIG. 9, it is close enough to the reed switch to effect its actuation. This expedient serves to make it feasible to use a relatively short magnet assembly housing which may more readily fit into the allotted space within the toothbrush handle.

FIGS. 11, 12, and 13 illustrate a slightly different embodiment from the toothbrush 21 illustrated in FIG. 2. A toothbrush generally designated 39 includes a handle portion 40 having a first end 46. Toothbrush 39 also includes a toothbrush head insert 41 having a neck portion 44 and a head portion 42, with bristles 43 attached or embedded to the head portion 42. As illustrated in FIG. 12 and FIG. 13, the second end 47 of handle portion 40 includes a toothbrush head receptacle 45 for receiving the neck portion 44 of the toothbrush head insert 41. Also as illustrated in FIG. 13, the electrical subassembly 23 is embedded or encased in the handle portion 40, with LED light 24 attached to the surface of the handle portion 40.

With this embodiment, a plurality of users, each having his or her assigned toothbrush head insert 41, may share the handle portion 40 which incorporates the electro-mechanical elements to provide a positive feedback indication of recommended toothbrushing technique. In addition, worn out toothbrush head inserts may be discarded and new replacements used with the handle portion 40.

Various changes and modifications to the embodiment herein chosen for purposes of illustration will readily occur to those skilled in the art. For example, the body portion of the toothbrush may include a plurality of lights responsive simultaneously or sequentially to recommended toothbrushing technique. Still further, the body portion of the toothbrush may include an aural indicator responsive to recommended toothbrushing technique. The aural indicator may be directly substituted for the light 24 in order, for example, that the desired improvement in toothbrushing technique may be enjoyed by visually impaired people. Also, it will be readily evident that both visual and aural indicators can be employed in the same toothbrush.

To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

I claim:

1. A toothbrush for cleaning teeth and for reinforcing recommended toothbrushing technique, said toothbrush comprising:

a) an elongate body, said elongate body including:
   i) a cleaning means disposed proximate a first end of said elongate body; and
   ii) a handle proximate a second end of said elongate body;

b) indicator means carried by said body for emitting a signal only when said toothbrush is moved in reciprocal lateral direction, the indicator means including a signal device and a printed circuit board having conductor means electrically coupled to the signal device.

2. The toothbrush of claim 1 wherein said signal device includes a light.

3. The toothbrush of claim 2 wherein said light includes an optically clear surface.

4. The toothbrush of claim 1 wherein said signal device includes a light emitting diode.

5. The toothbrush of claim 4 wherein said light emitting diode includes an optically clear surface.

6. The toothbrush of claim 1 wherein said signal device includes an aural device for emitting a noise signal during reciprocal lateral movement of said toothbrush.

7. The toothbrush of claim 6 wherein said aural device includes a buzzer.

8. The toothbrush of claim 6 wherein said aural device includes a bell.

9. A toothbrush for cleaning teeth and for reinforcing recommended toothbrushing technique, said toothbrush comprising:

a) a toothbrush head insert, said toothbrush head insert including:
   i) a cleaning means disposed proximate a first end thereof; and
   ii) a neck portion disposed proximate a second end thereof;

b) a handle, said handle including a toothbrush handle coupling means for receiving said neck portion of said toothbrush head insert, such that after said toothbrush head insert is used, said insert may be removed and replaced by a different insert;

c) indicator means in said handle including electrical means for selectively actuating said indicator means only during reciprocal lateral movement of said toothbrush for reinforcing recommended toothbrushing technique carried by the handle.

10. The toothbrush of claim 9 wherein said cleaning means further includes a toothbrush head having toothbrush bristles fixedly attached thereto.

11. The toothbrush of claim 9 wherein said indicator means includes a light.

12. The toothbrush of claim 11 wherein said light includes an optically clear surface.

13. The toothbrush of claim 9 wherein said indicator means includes a light emitting diode.

14. The toothbrush of claim 13 wherein said light emitting diode includes an optically clear surface.

15. The toothbrush of claim 9 wherein said indicator means includes an aural indicator means for emitting a noise during reciprocal lateral motion of said toothbrush during toothbrushing.

16. The toothbrush of claim 15 wherein said aural indicator means includes a buzzer.

17. The toothbrush of claim 15 wherein said aural indicator means includes a bell.

18. The toothbrush of claim 9 wherein said electrical means includes an electrical subassembly which includes a power source, a switch means and said indicator means, coupled in series to form an electrical circuit.

19. The toothbrush of claim 18 wherein said power source includes a battery.

20. The toothbrush of claim 18 wherein said switch means includes:

a) a magnet subassembly comprising:
   a housing, said housing having opposing ends;
   a first stationary magnet and a second stationary magnet, said first stationary magnet fixedly attached at one of said opposing ends of said housing, said second stationary magnet fixedly attached at the other said opposing end of said housing;
   a movable magnet situated intermediate said first and second stationary magnets in said housing, said movable magnet being bidirectionally movably positioned within said housing therebetween, said first and second stationary magnets being respectfully oriented to repel said movable magnet;

b) a reed switch normally in an open position, said reed switch being positioned angularly adjacent said magnet subassembly such that when said movable magnet moves, as a result of its inertia, sufficiently close to said reed switch during reciprocal lateral movement of said toothbrush during brushing, said reed switch closes, thereby completing said electrical circuit and activating said indicator means.

21. The toothbrush of claim 20 which said magnet subassembly is oriented within said body of said toothbrush such that said indicator means is energized only when said toothbrush is moved in a reciprocal lateral motion during toothbrushing.

22. The toothbrush of claim 9 wherein said indicator means includes conductor means for electrically integrating said indicator means.

23. The toothbrush of claim 22 wherein said conductor means includes a printed circuit board.

24. A toothbrush for cleaning teeth and for reinforcing recommended toothbrushing technique, said toothbrush comprising:

a) an elongate body, said elongate body including:

i) a cleaning means disposed proximate a first end of said elongate body; and ii) a handle proximate a second end of said elongate body;

b) indicator means carried by said body for emitting a signal when said toothbrush is moved in reciprocal lateral direction, said indicator means including a signal device, a power source and switch means coupled to form an electrical circuit, said switch means further includes:

i) a magnet subassembly comprising:

a housing, said housing having opposing ends;

a first stationary magnet and a second stationary magnet, said first stationary magnet fixedly attached at one of said opposing ends of said housing, said second stationary magnet fixedly attached at the other said opposing end of said housing;

a movable magnet situated intermediate said first and second stationary magnets in said housing, said movable magnet being bidirectionally movably positioned within said housing therebetween, said first and second stationary magnets being respectfully oriented to repel said movable magnet; and ii) a reed switch normally in an open position, said reed switch being positioned angularly adjacent said magnet subassembly such that when said movable magnet moves, as a result of its inertia, sufficiently close to said reed switch during reciprocal lateral movement of said toothbrush during toothbrushing, said reed switch closes, thereby completing said electrical circuit and activating said indicator means.

25. The toothbrush of claim 24 in which said magnet subassembly is oriented within said body of said toothbrush such that said indicator means is energized only when said toothbrush is moved in a reciprocal lateral motion during toothbrushing.

* * * * *